US011498200B1

(12) United States Patent
Baveloni

(10) Patent No.: US 11,498,200 B1
(45) Date of Patent: Nov. 15, 2022

(54) TRADESPERSON WORKSTATION

(71) Applicant: Diego Baveloni, Yarmouth, MA (US)

(72) Inventor: Diego Baveloni, Yarmouth, MA (US)

( * ) Notice: Subject to any disclaimer, the term of this patent is extended or adjusted under 35 U.S.C. 154(b) by 0 days.

(21) Appl. No.: 17/746,213

(22) Filed: May 17, 2022

Related U.S. Application Data

(60) Provisional application No. 63/189,603, filed on May 17, 2021.

(51) Int. Cl.
*B25H 1/04* (2006.01)
*B25H 1/10* (2006.01)
*B25H 1/16* (2006.01)

(52) U.S. Cl.
CPC ..... *B25H 1/04* (2013.01); *B25H 1/10* (2013.01); *B25H 1/16* (2013.01)

(58) Field of Classification Search
CPC ..... A47B 1/04; A47B 1/08; B23D 47/025; B23Q 1/74; B25H 1/005; B25H 1/04; B25H 1/10; B25H 1/16; B60B 33/06; B60B 33/04
See application file for complete search history.

(56) References Cited

U.S. PATENT DOCUMENTS 4,782,917 A * 11/1988 Schulz ..... E04G 1/34 182/182.4
4,974,651 A * 12/1990 Carmon ..... B25H 1/04 144/287
5,105,862 A * 4/1992 Skinner ..... B23D 47/025 144/287
5,161,590 A * 11/1992 Otto ..... B27G 5/02 144/287
5,479,972 A * 1/1996 Keating ..... B23D 47/025 144/287
5,487,445 A * 1/1996 Biehl ..... B65G 39/025 269/289 MR
5,582,225 A * 12/1996 Schank ..... B23Q 1/032 144/286.1
5,836,365 A * 11/1998 Derecktor ..... B25H 1/06 144/286.5
2016/0039086 A1* 2/2016 Maes ..... B25H 1/12 280/30
2016/0176003 A1* 6/2016 Reckevicius ..... B25B 11/02 29/592

* cited by examiner

*Primary Examiner* — Tyrone V Hall, Jr.

(57) ABSTRACT

A system suitable for use as a portable tradesperson workstation is presented. The system includes a main table configured to support and connect with a material working apparatus, the main table positionable on top of and connected to associated adjustable support legs. The system also includes two center adjustment brackets positionable on top of and connected to opposite ends of the main table. Additionally, the system includes a preparation area extension, with associated adjustable support legs, connected to the main table with one of the center adjustment brackets on a top left-hand side of the main table. Further, the system includes a post product working area extension, with associated adjustable support legs, connected to the main table with the other center adjustment bracket on a top right-hand side of the main table. The system is configured to form an assembly and configured for transportation as a portable tradesperson workstation.

18 Claims, 12 Drawing Sheets

TRADESPERSON WORKSTATION

RELATED APPLICATIONS

This application claims priority to U.S. Non-Provisional Application No. 63/189,603 filed May 17, 2021. The entire contents of the above application are hereby incorporated by reference as though fully set forth herein.

FIELD OF THE INVENTION

The present invention relates generally to workstations, and more particularly, to tradesperson workstations, which utilize multiple interconnectable and adjustable workstation extensions to provide for an increased efficiency portable workstation and enhanced safety for users of the tradesperson workstations.

BACKGROUND OF THE INVENTION

Many methods and devices have been unsuccessfully attempted to efficiently and effectively provide portable carpenter workstations which can be utilized in any location. Several devices, systems, and methods have been created and implemented to address the problem of having a variety of different carpentry evolutions such as measuring, cutting wood in three dimensions, preassemble pieces, and prepare for installation and to be utilized in a variety of locations while being able to easily perform the required actions to produce a specifically measured component. However, those efforts often resulted in increased costs due to the time required to produce a worked piece, workstation user injuries due to inadequate ergonomic design, and employee fatigue.

Previous workstations often included working surfaces which were physically separated and were standalone. This created the need for carpenters to move between the different surfaces in order to produce a specific cut wooden piece. This additional movement meant more time required to perform the required work. Further, these previous workstations often were put together with ineffective components and resulted in additional costs.

Further, previous workstations often consisted of a saw table and then putting together horizontal surfaces on sawhorses and placing them in the vicinity of the saw table to allow a carpenter to measure pieces of wood then to cut the pieces and then to preassemble the pieces prior to installation on the house structure. These types of set ups were not ergonomic in nature, were not adjustable, and often created safety hazards.

These additional pieces resulted in additional expenses and did not provide for ease of work production and made the measuring, cutting, and preassembly evolutions cumbersome.

Accordingly, there is an established need for workstations which solve at least one of the aforementioned problems. Further, there is an established need for carpenter workstations which can be utilized more efficiently and effectively and provide carpenters with ergonomically designed workstations to increase work production and reduce safety hazards.

SUMMARY OF THE INVENTION

The present invention is directed to innovative and cost-effective carpenter workstations which are configured to provide enhanced safety for carpenters working on the workstation, provide for an ergonomically designed workstation wherein the carpenter's body position and body movements required to produce the cut wood pieces reduce physical exertion, reduce the number of physical movements of the carpenter's body to produce the pieces, and provide for an increased production work product output from the carpenter.

In an aspect a system suitable for use as a portable tradesperson workstation is presented. The system includes a main table configured to support and connect with a material working apparatus, the main table positionable on top of and connected to associated adjustable support legs. The system also includes two center adjustment brackets positionable on top of and connected to opposite ends of the main table. Additionally, the system includes a preparation area extension, with associated adjustable support legs, connected to the main table with one of the center adjustment brackets on a top left-hand side of the main table. Further, the system includes a post product working area extension, with associated adjustable support legs, connected to the main table with the other center adjustment bracket on a top right-hand side of the main table. Also, the system is configured wherein the associated legs of the main table are foldable and collapsible within an underneath void of the main table to form a stored main table assembly, the associated adjustable support legs of the preparation area extension are foldable and collapsible within an underneath void of the preparation area extension to form a stored preparation area extension assembly, and the associated adjustable support legs of the post product working area extension are foldable and collapsible within an underneath void area of the post product working area to form a stored post product working area assembly and wherein the stored main table assembly, the stored preparation area extension assembly, and the stored post production working area assembly are connected together and configured for transportation as a portable tradesperson workstation.

In embodiments, the workstation can be configured to work on interior trim work for residential and commercial buildings by incorporating extensions to a saw table and placement of wood guides, wood measuring devices, and hooks on the extensions.

In embodiments, the workstation extensions can be vertically adjustable.

In embodiments, the vertical adjustments can be carried out by a servomotor, hydraulic, or pneumatic controls.

In embodiments, the workstation extensions can include hooks. The hooks sized and positionable on the extensions for specific tools to be utilized at particular locations along the extensions and saw table.

In embodiments, the workstation can include an insulating layer. The insulating layer structured to minimize transmission of vibration from the saw while in operation. Further, the workstation can include a plurality of insulating layers positionable in between workstation components and arranged to minimize vibration transmission.

In embodiments, the workstation can include acrylonitrile butadiene styrene (ABS) plastic.

In an embodiment of the present invention, the carpenter workstation can include materials such as Polylactic acid (PLA).

In another embodiment, the workstation can also include Thermoplastic polyurethane (TPU).

In embodiments, the workstation can include interconnecting extensions, the extensions configured to be connected horizontally without the need of any tools to perform interconnecting the extensions with the saw table.

In embodiments, the system can include a main table configured to support a material working apparatus including, but not limited to a chop saw, rip saw, miter saw, pipe bender, router, planer, jigsaw, welding machine, pipe threader, lathe, CNC equipment, 3-D laser apparatus, and/or sander.

In an aspect, the workstation can include materials such as, but not limited to wood, ceramic, metal, composites, and/or synthetic materials, and laminated particle board, designed such that the workstation can include a smooth low surface friction layer to allow wood pieces to be easily moved over the surface without damaging the pieces of wood.

In embodiments, the workstation can be formed from lightweight materials such that the workstation can be easily maneuvered and transported.

In another aspect, the workstation can also include an anti-microbial coating.

In an embodiment, the workstation can include rectangular, hexagonal, oval, trapezoidal, circular, and/or other multi-sided shapes. In embodiments, the shape of the workstation components can be configured to provide interfaces between a saw table and extensions. Further, the shapes can be incorporated into the hooks to provide proper storage of specialty tools.

In an embodiment, the workstation can include hooks, the hooks configured to store tools. The hooks can be positioned along the workstation such that the tools are placed where the carpenter will be physically performing evolutions which require those tools.

In embodiments, the workstation can accommodate working on pieces of wood of various sizes and shapes including but not limited to ¼, ½, 1, 2, 3, 6, 12, 16, 24, 36, 40, 64, and/or 72 inches or any dimension in between.

In another embodiment, the workstation can also include materials, such as but not limited to aluminum, steel, composites, synthetic plastics, and/or rubberized material. The material structured to provide resistance to infectious diseases, water resistance and/or anti-microbial properties.

In an aspect, the workstation can include coating materials. The coating materials arranged to minimize surface friction and to mitigate microbial and/or viral transmission. Further, the coatings can be configured to retard moisture and/or eliminate unwanted biological growth.

In another embodiment, the workstation can also include polypropylene configured to produce the workstation components with injection molding.

In embodiments, the workstation can include swivel points, the swivel points configured to connect workstation components allowing for fast and easy adjustment of workstation components in three dimensions.

In embodiments, the workstation can include worm gears, the worm gears designed to allow horizontal and vertical adjustment of workstation components.

In embodiments, the workstation can include handles positionable on workstation components to provide easy portability of workstation components. Further, in embodiments the system can include wheels attached to an embodiment of a portable tradesperson workstation to allow transportation of the workstation over a distance.

In embodiments, the workstation can be designed to safely support about 400 lbs. of material.

In embodiments, the workstation components can be configured to weigh less than 40 lbs.

In embodiments, the workstation can include quick release hooks.

In embodiments, the workstation can include coated hooks designed to allow for easier and quicker stowing and removal of tools to and from the hooks.

In embodiments, the workstation can include hooks with swivels configured to allow rotation of tools on the hooks.

In embodiments, the workstation can include power supplies arranged such that power tools have power supplies at positions on the workstation wherein those tools will be utilized.

In embodiments, the workstation can include components with surface layers, the surface layers including Teflon, nonstick materials, and sacrificial layers which can be changed out upon depletion.

In embodiments, the workstation can include portable miter saw stands with a plurality of work platforms interconnected allowing for ease of measuring, securing pieces while cutting and working on the pieces, assembling pieces together, and areas for allowing dwell time for preassembled pieces prior to attachment of the pieces to a structure.

In embodiments, the workstation can be configured to perform a plurality of wood working evolutions including but not limited to interior and exterior work.

In embodiments, the workstation can be configured for trade specific evolutions such as but not limited to carpentry, plumbing, electrical, masonry, and mechanical work such that the system can include working surfaces to allow measuring areas, areas for placement of items with guides to ensure accurate working of pieces, areas for cutting and modifying the pieces, areas for preassembly and joining pieces together, and areas for setup and preinstallation lay down stations.

In embodiments, the workstation can include miter saws and thickness planers.

In embodiments, the workstation can include markings from center on a main table to an extension as a ruler to provide quick rough cuts on pieces.

In embodiments, the workstation can include slots configured to support future products with a T-bolt.

In embodiments, the workstation can include power strips on main table and extensions.

In embodiments, the workstation can include plastic and/or rubber protective components on sides and tops of extensions to provide ease of in cutting intricate and detailed products such as furniture or pre-finished cabinet parts.

In embodiments, the workstation can include telescopic lights and/or poles arranged to mount on slots and designed to be adjustable in three dimensions.

In embodiments, the workstation can include bench clamps positionable on a plurality of locations on the workstation to provide securing mechanisms of work pieces onto the workstation.

In embodiments, the workstation can include a plurality of extensions mounted through slots for longer and/or wider working platforms.

In embodiments, the workstation can include a nominal pencil sharpener, a carpenter's pencil sharpener, a soldering station, a welding platform, electrical grounding system, and/or a working piece heating/cooling area.

In embodiments, the workstation can include manual or electronic fence systems mounted on extensions.

In embodiments, the workstation can include a battery charging station.

In embodiments, the workstation can include container opening and closing devices for beverage bottles, beverage cans, paint cans, electrical flux containers, and solvent containers.

In embodiments, the workstation can include a table saw assembly, the table saw assembly can include a table saw, table, adjustable height mechanisms, adjustable height brackets to connect with pre and post work extensions, a plurality of extensions configured to connect to other extensions designed to allow longer rips on wood, plastic, metal, composite, or ceramic items, and additional extenders for production line rips.

In embodiments, the workstation can include taller brackets to support extensions and can be used as a table saw stand.

In embodiments, the workstation can include height adjustment mechanisms to allow having a main table at a lower setting and extensions higher.

In embodiments, the workstation can include a mitre saw,

These and other objects, features, and advantages of the present invention will become more apparent from the attached drawings and the detailed description of the preferred embodiments, which follow. It is understood that the drawings are designed for the purposes of illustration and not as a definition of the limits of the embodiments of the present invention. It should be further understood that the drawings are not necessarily drawn to scale and are merely intended to conceptually illustrate the methods and systems described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
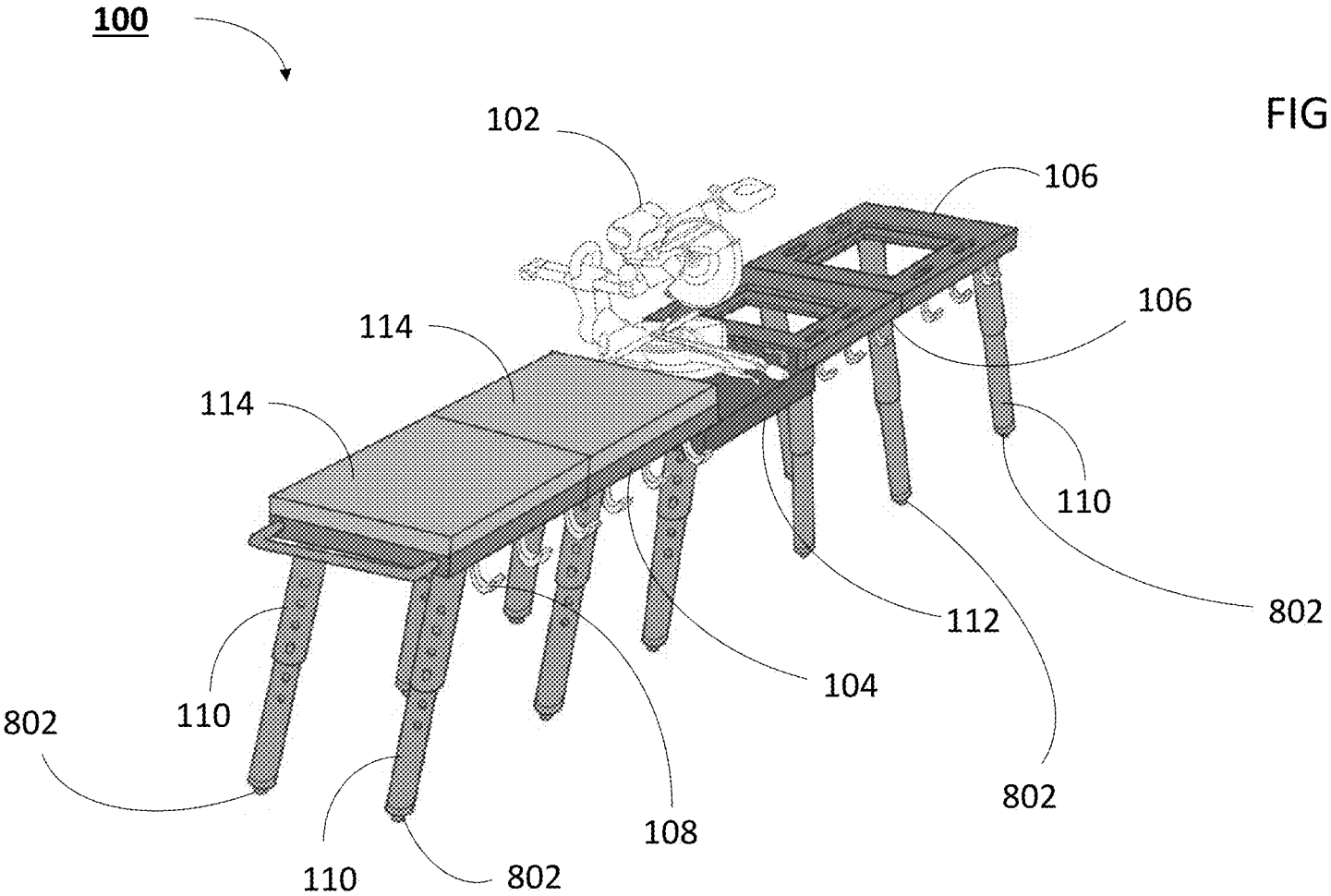
FIG. 1 presents a top perspective view of a workstation, in accordance with an embodiment of the present invention.

Referring initially to FIG. 1, a top left hand side perspective view of a workstation 100 with a miter saw 102 is shown. The workstation 100 can include preparation area extensions 104. The workstation can also include post cutting product working extensions 106 where tradesmen can modify pieces of material being worked on. The workstation 100 can include hooks 108 configured to stow tools (not shown) for tradesmen to utilize in preparing the material. Further, the workstation 100 can include adjustable legs 110 to allow vertical adjustment of the components of the workstation 100. As best shown in FIG. 1, the workstation 100 can include a main table 112 whereupon a plurality of wood working devices and material working apparatus such as table saws and miter saws, and planers can be supported and connected to. The workstation can also include a main table 112 whereupon a plurality of material working tools such as pipe cutters, pipe threaders, ceramic saws, pipe benders, and pipe flanging tools, can be positioned upon.

The workstation 100 can include surface layers 114 which can be positionable on extensions 104 and 106 designed to include low sliding friction surfaces to allow ease of moving materials across surfaces of the surface layers 114. Additionally, the workstation 100 can include manual and automatic vertical displacement adjustment devices 802 positionable on bottom of the adjustable legs 110 in order to provide a refined horizontal level control of working extensions 106 and 104.

Figure 2:
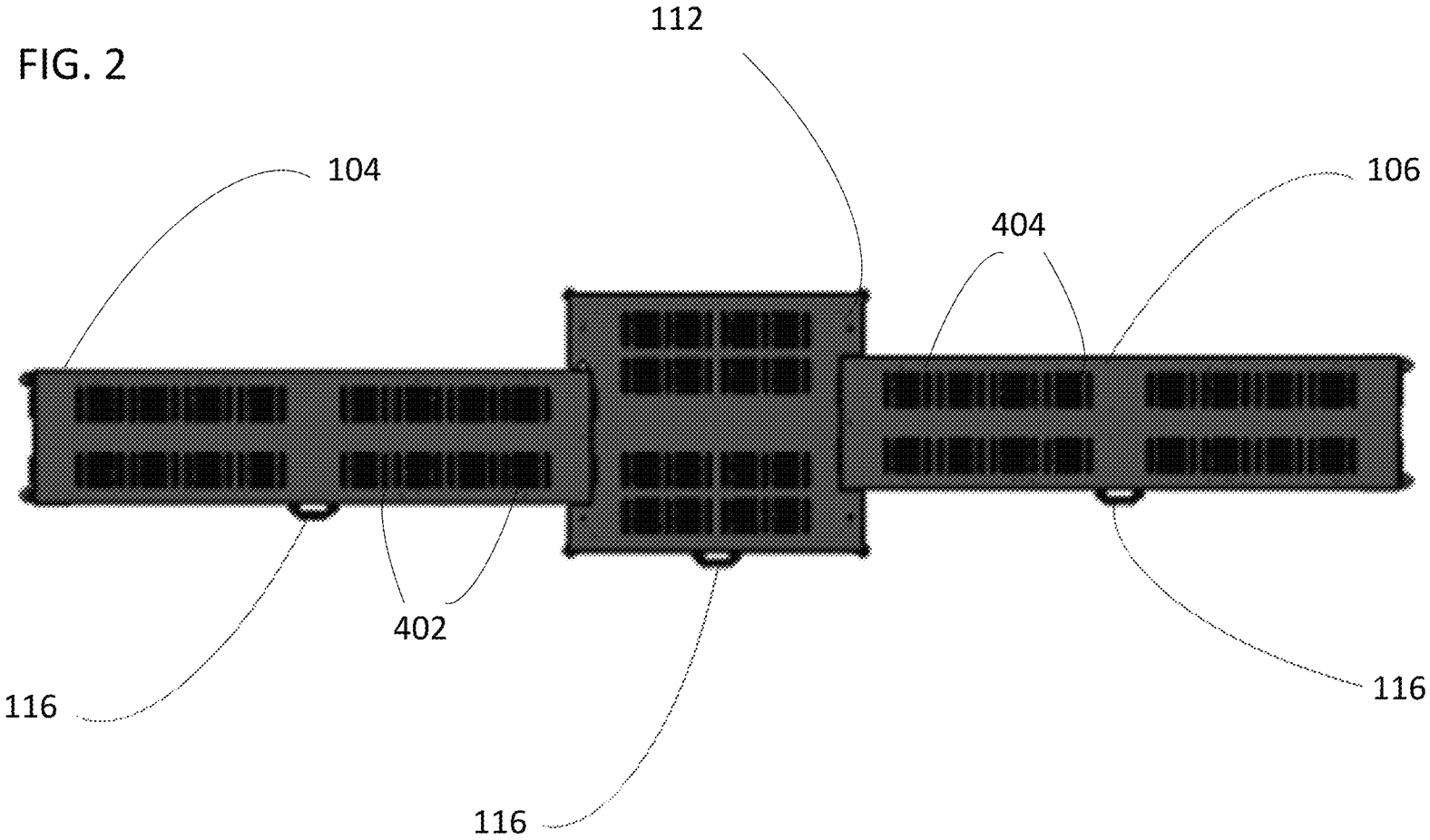
FIG. 2 presents a top view of workstation with a miter saw.
Figure 4:
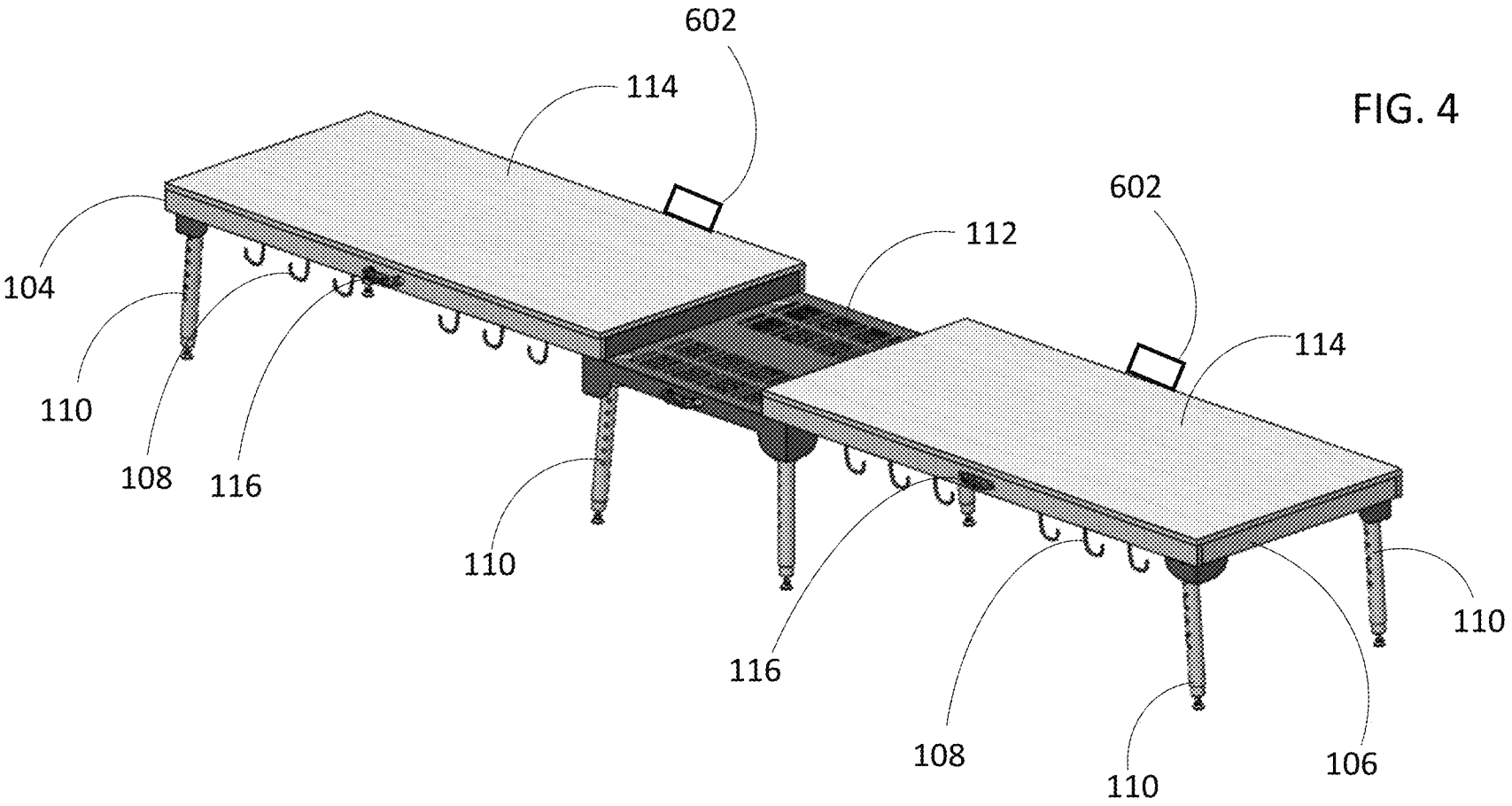
FIG. 4 presents a front top right hand side perspective view of a workstation.
Figure 11:
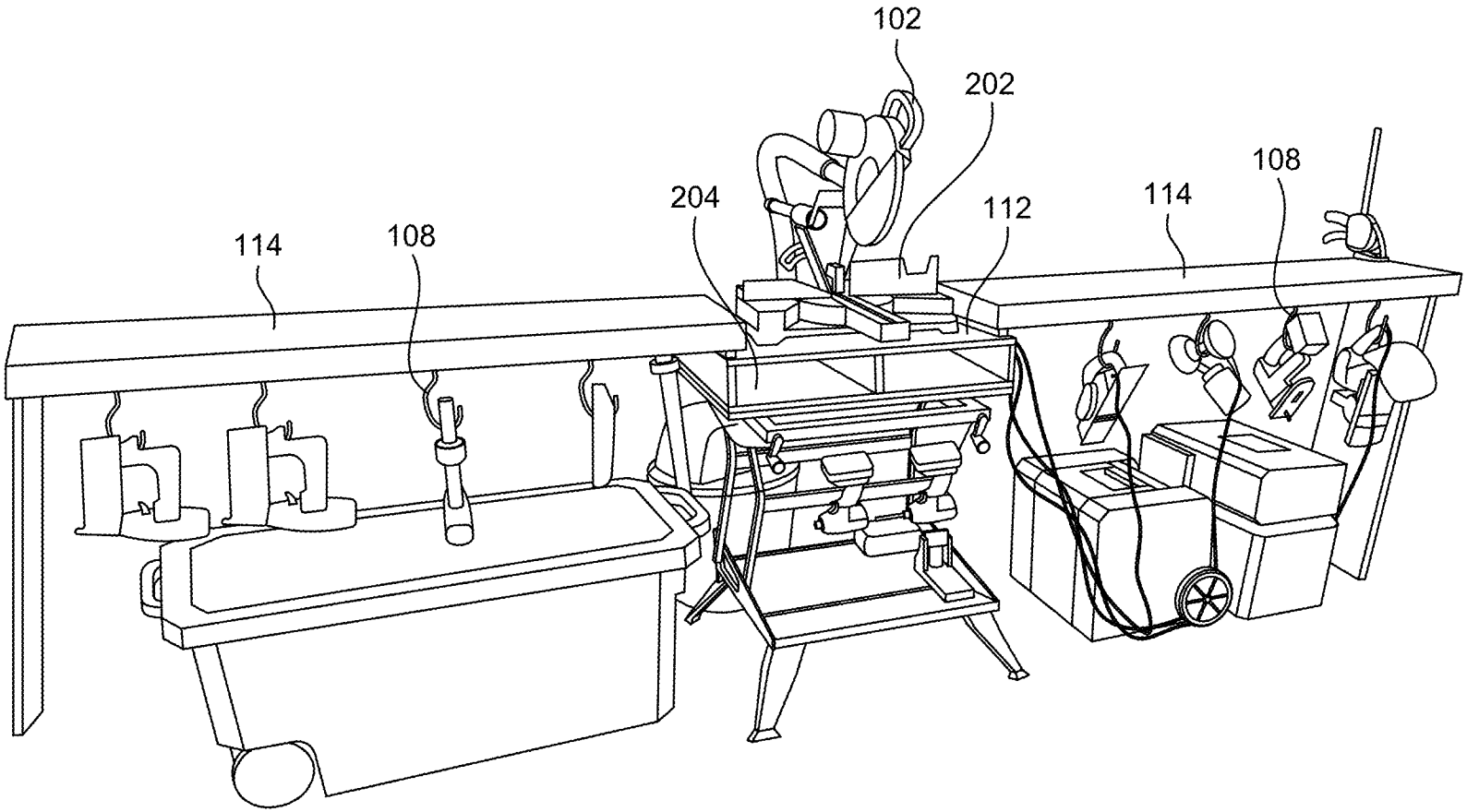
FIG. 11 presents a front perspective view of a workstation in accordance with an embodiment of the present invention is use in the field.

Turning to FIG. 2, the workstation 100 can include handles 116 positionable on components of the workstation 100 providing for ease of mobility between work sites. As shown In FIG. 2, the workstation can include extensions 104 and 106 with varying lengths and widths. Further, the workstation 100 can include a main table 112 that can be wider in order to support larger material working tools. As best seen in FIG. 2, embodiments of the workstation 100 can include surfaces wherein a plurality of slots 402 are formed into and positionable onto the working surfaces of the extensions 104 and 106. The plurality of slots 402 can be arranged in a symmetrical fashion across a surface of the extensions 104 and 106 and allow for working debris such as product dust and/or material created during working of material on the working surfaces of the workstation 100 to fall down through the slots. Further, the slots 402 can be configured to allow dust and other debris to be removed down through the slots 402 by a vacuum system (as shown in FIGS. 4 and 11). Also, as seen in FIG. 2, embodiments of the workstation 100 can include micro roller mechanisms 404 positionable symmetrically on the working surfaces of the workstation 100 and structured to provide enhanced work material movement control by a user of the workstation 100 and allow for improved cutting performance.

Figure 3:
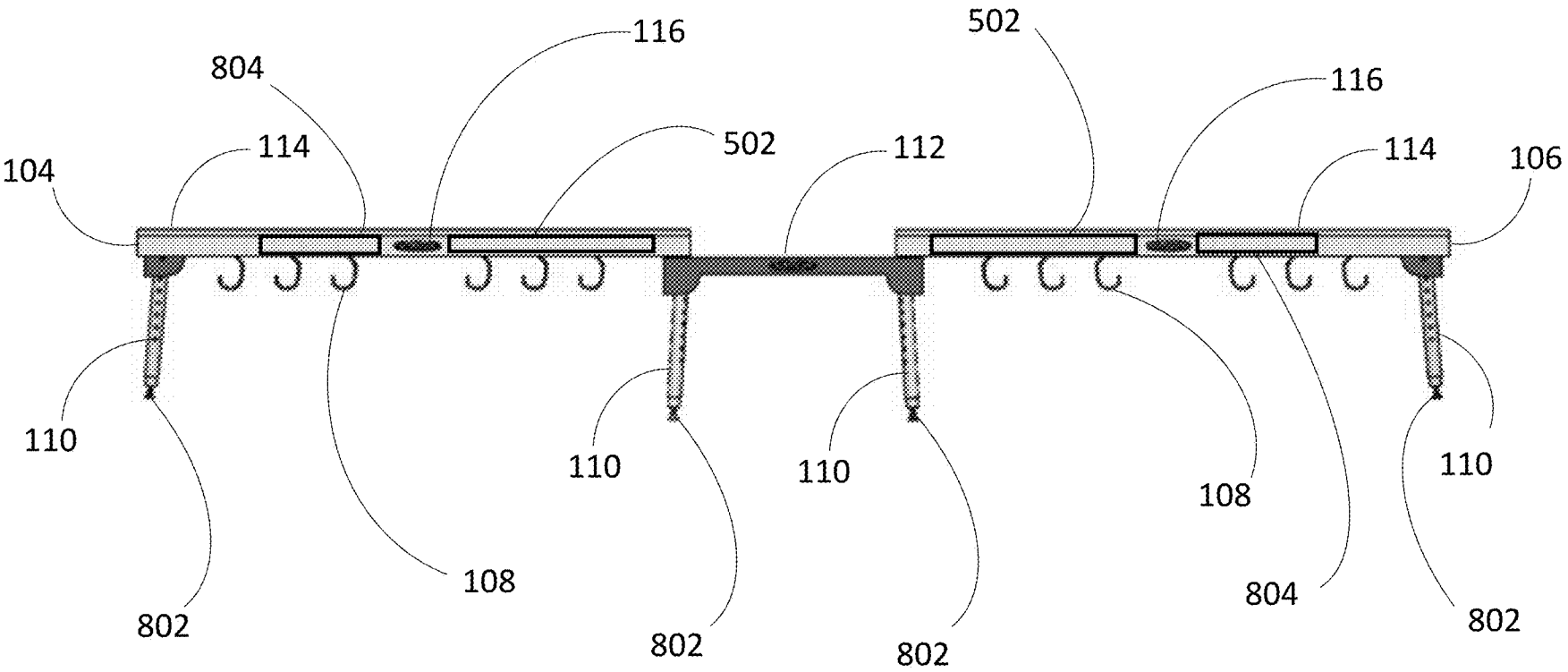
FIG. 3 presents a front view of a workstation.

FIG. 3 is a front side view of a workstation 100. The workstation can include adjustable legs 110 allowing the extensions 104 and 106 to have different heights based on the material working evolutions that are being carried out on the workstation 100. The extensions 104 and 106 can include hooks 108 positionable under bottoms of the extensions 104 and 106 providing staging areas for hand tools for tradesmen to have at the ready various power tools and hand tools to work on the material (as best seen in FIG. 11). Also seen in FIG. 3 are the manual and automatic vertical adjustment mechanisms 802 designed to allow a user of the workstation 100 to fine tune and level working surfaces of the workstation 100 utilizing a high precision bubble level and/or electronic leveling device 804 positionable on a front side of the extensions 104 and 106. Further, the workstation 100 can include sliding drawer vacuum tray assemblies 502 mounted underneath a bottom surface of the workstation 100 working surfaces and connected with vacuum attachment connections 602 (as shown in FIGS. 4 and 11) in order to remove debris and/or dust from the working surfaces of the workstation through the plurality of slots 402 on the surfaces of the workstation 100.

FIG. 4 illustrates how embodiments of the workstation 100 can include extensions 104 and 106 with surface layers 114 which can be smooth throughout a top surface. The workstation 100 can include adjustable legs 110 which can allow for varying the vertical heights of the main table 112 and extensions 104 and 106. Further, the workstation 100 can include extensions 104 and 106 with the same or larger width as the main table 112. Further, the workstation 100 can include vacuum attachment connections 602 positionable on a backside of the workstation 100 and can be designed to connect to vacuum tray assemblies 502 which can draw suction onto the assemblies 502 which can collect dust from the plurality of slots 402 to remove dust and debris with a vacuum system.

Figure 5:
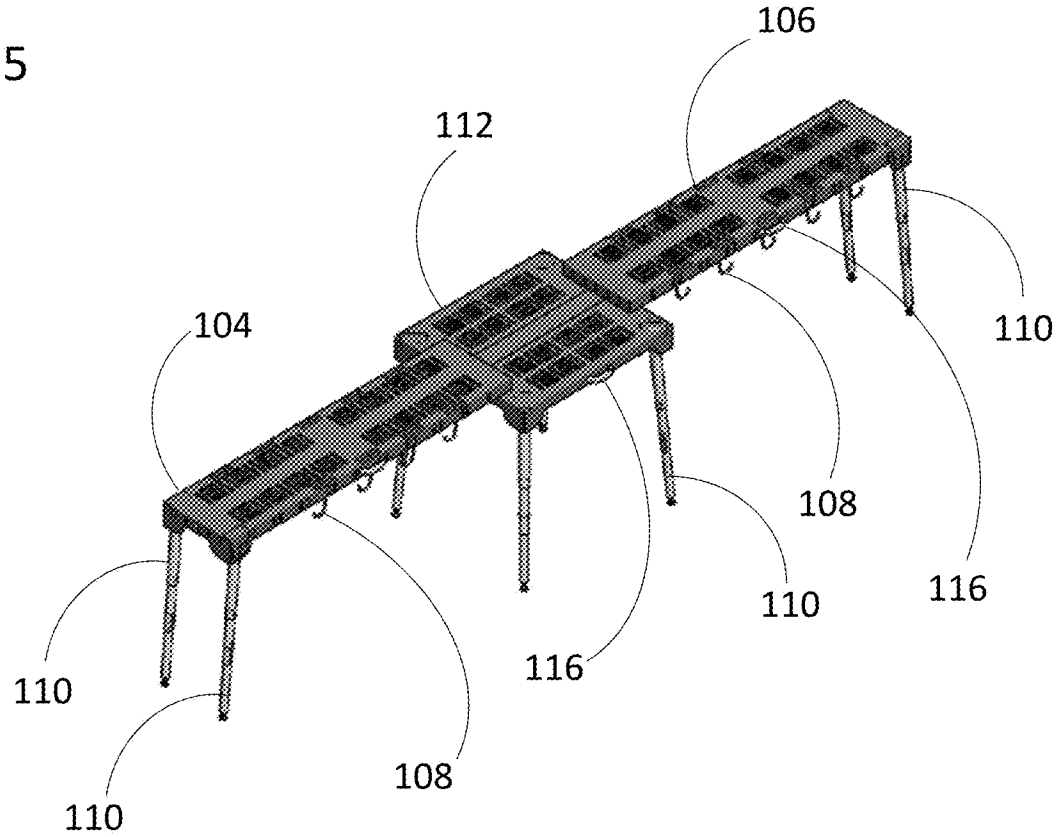
FIG. 5 presents a front top left hand side view of a workstation.

FIG. 5 displays a top left hand side perspective view of the workstation 100. The workstation 100 can include hooks 108 positionable on a front side of extensions 104 and 106 and can also be positionable under a bottom surface of the extensions 104 and 106. As seen in the present embodiment the workstation 100 can include connection points between the main table 112 and the extensions 104 and 106. Further, the workstation 100 can be configured to have workstation 100 components with adjustable vertical displacement with adjustable legs 110.

Figure 6:
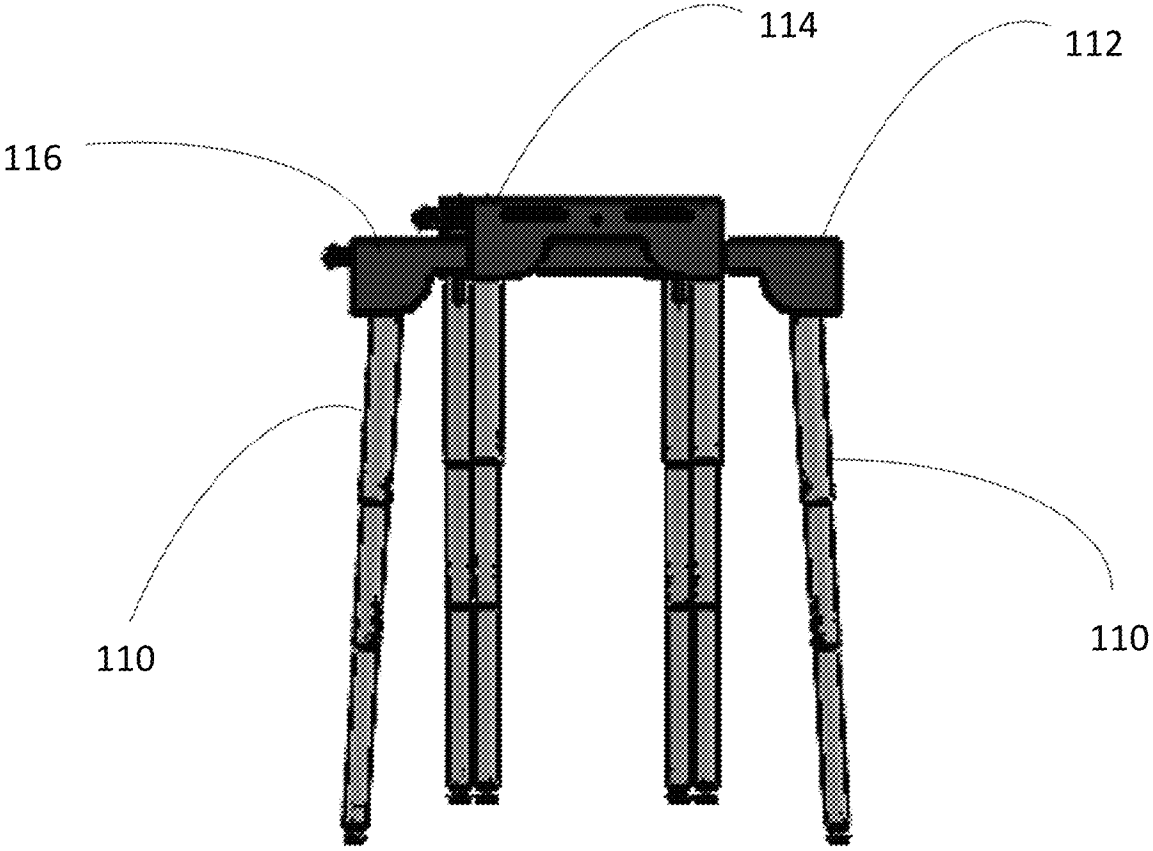
FIG. 6 presents a right-hand side view of a workstation in accordance with an embodiment of the present invention.

Referencing FIG. 6, a left-hand side view of the workstation 100 shows that the workstation 100 components can include different widths.

Figure 7:
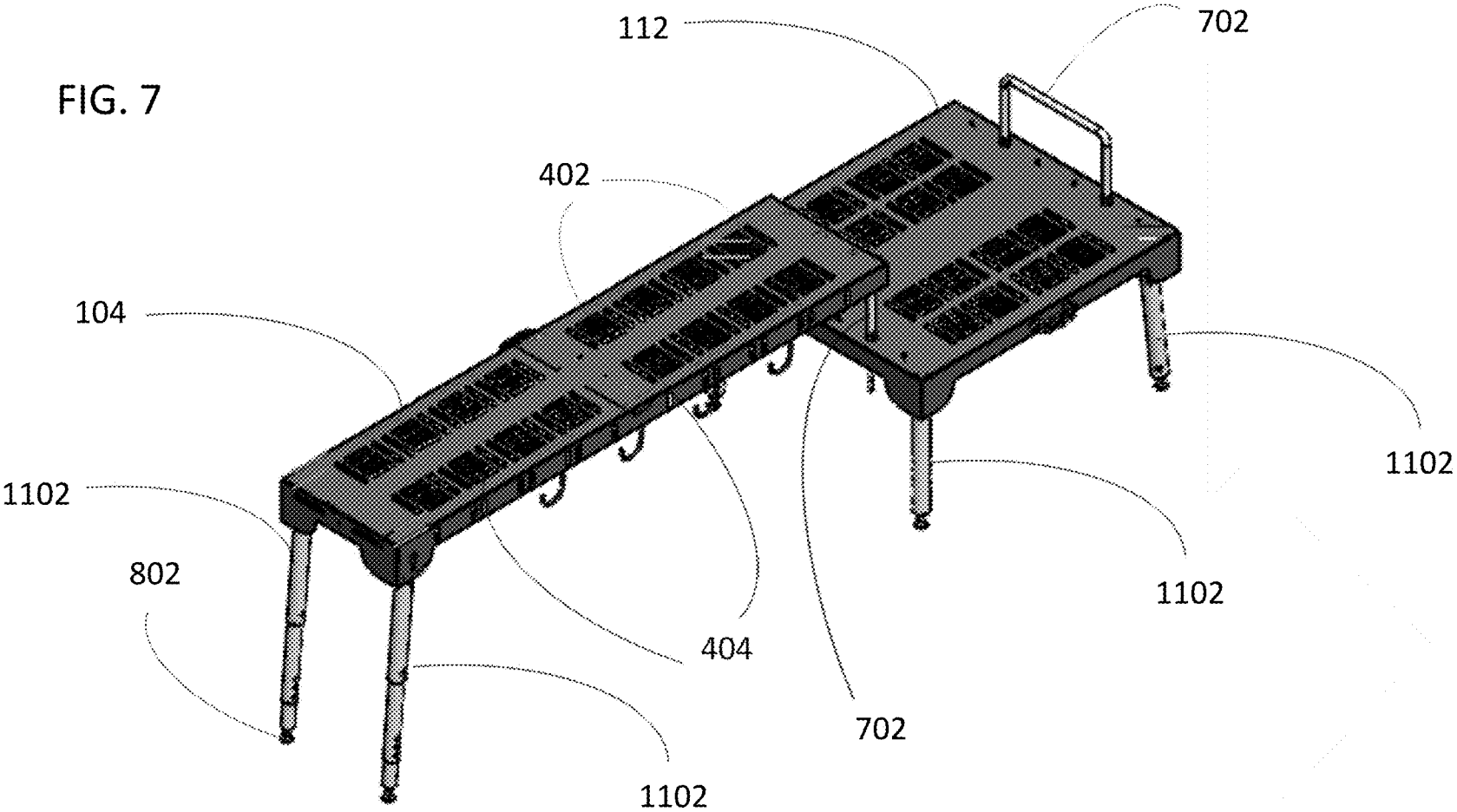
FIG. 7 presents a left-hand side top perspective view of a workstation in accordance with an embodiment of the present invention.

FIG. 7 shows a left-hand side exploded view of a portion of a workstation 100. As displayed, the workstation can include adjustable center brackets 702 positionable on opposite ends of the center worktable 112 and configured to adjust an elevation distance from a top surface of the worktable 112 and both left- and right-hand side extensions 104 and 106. The adjustable center brackets 702 can be manually and/or automatically and/or locally and/or remotely controlled to adjust an elevation distance between the working surfaces of the worktable 112 and the extensions 104 and 106. Also shown in FIG. 7 are a plurality of slots 402 and a plurality of rollers 404 positionable in a symmetrical fashion on the working surfaces of the workstation 110 extensions 104 and 106. Additionally, in embodiments, the system can include folding collapsible adjustable legs 1102 which can fold up and collapse within an underside void of the extensions 104 and 106 and main table 112.

Figure 8:
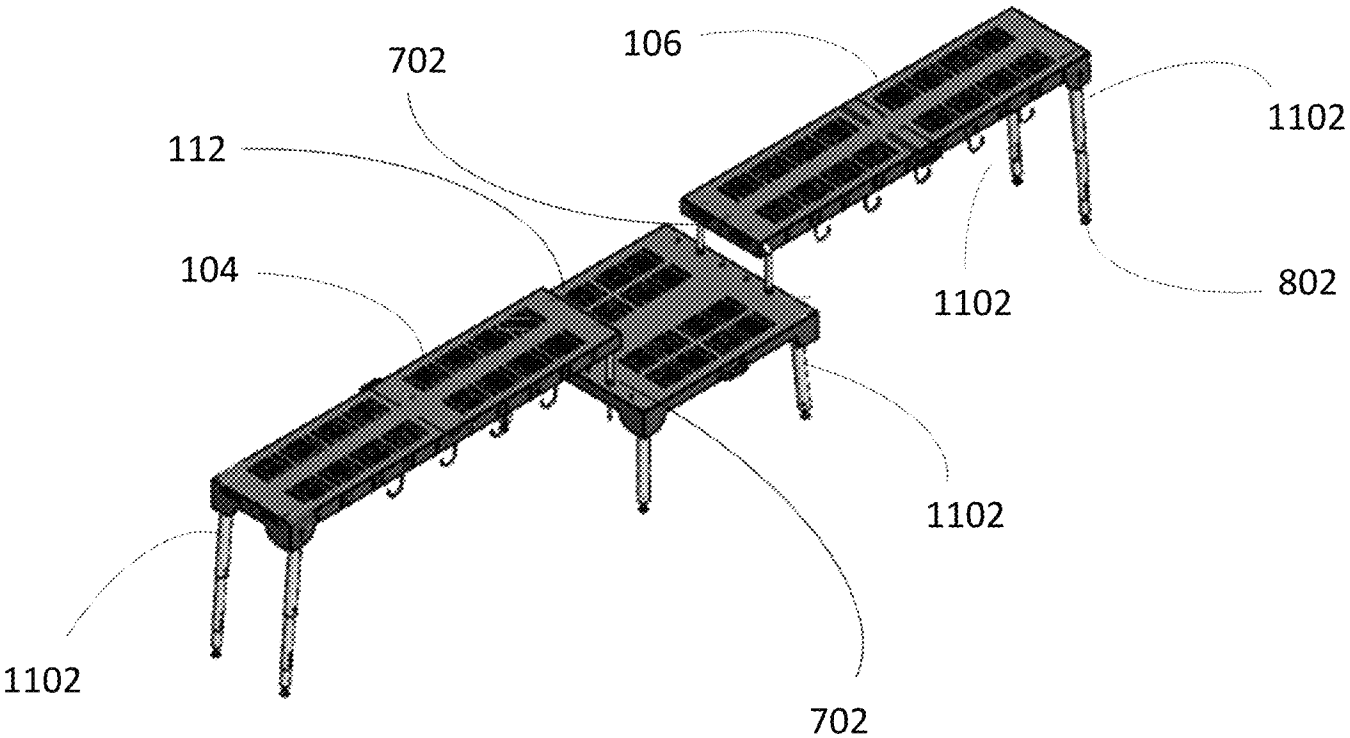
FIG. 8 presents another left-hand side top perspective view of a workstation in accordance with an embodiment of the present invention.

FIG. 8 is an exploded view of a workstation 100 illustrating the interaction between the workstation 100 worktable 112, the adjustable center brackets 702, extensions 104 and 106. the folding collapsible adjustable legs 1102, and the manual and/or automatic vertical displacement adjustment devices 802.

Figure 9:
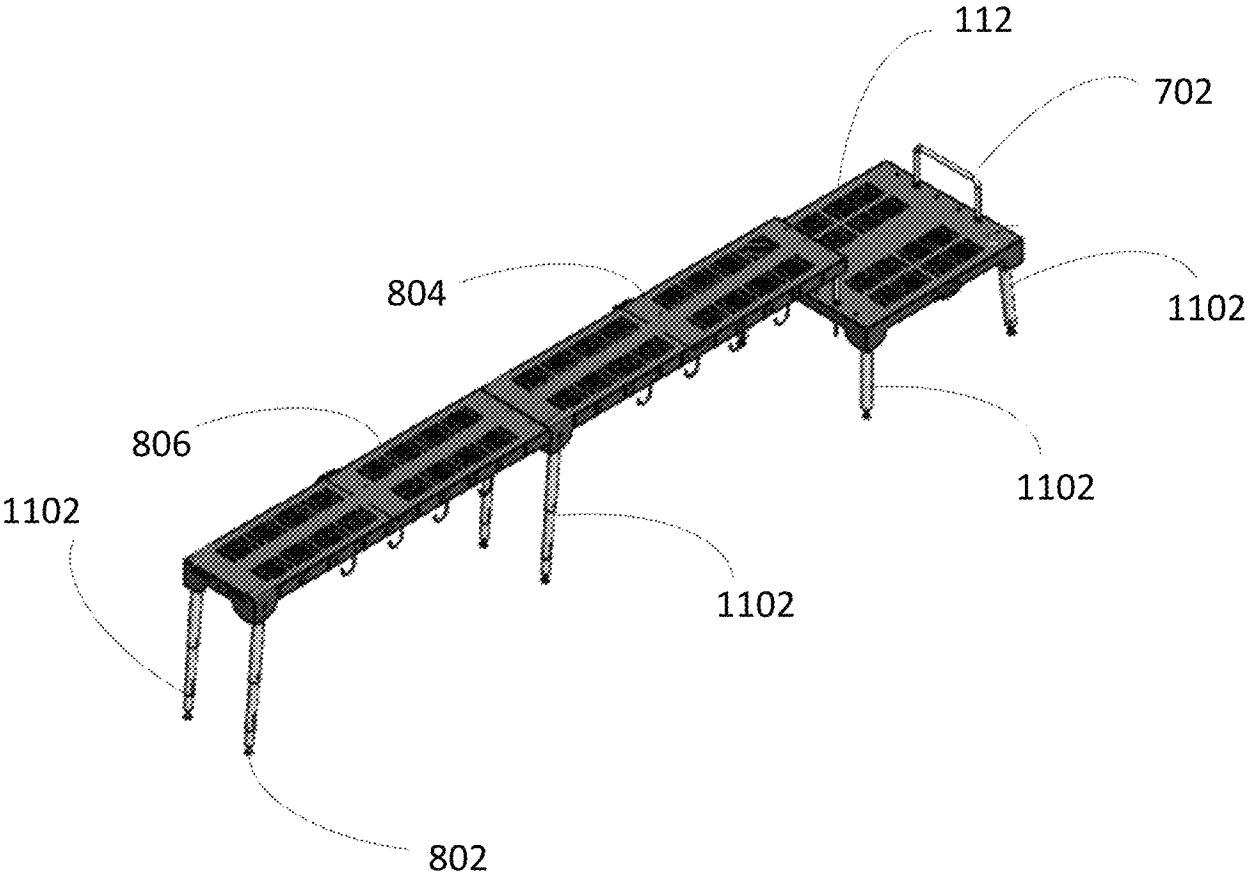
FIG. 9 presents another left-hand side top perspective view of a workstation in accordance with an embodiment of the present invention with an additional extension.

FIG. 9 illustrates an embodiment of the workstation 100 in which additional extension wings 804 and 806 can be connected to provide an elongated working surface area of the workstation 100. Although extensions 804 and 806 are shown on the left-hand side of the worktable, so can additional connected extensions be deployed on the right-hand side of the workstation 100. Also, in embodiments a plurality of workstation 100 extensions 104, 106, 804, and 806 can be connected horizontally to provide a continuous working surface for users of the workstation 100 for a plurality of length dimensions. The plurality of extensions can be connected with quick disconnect devices, leg to leg tubular snap on snap off connections, peg and hole connections, male and female connections, overlapping joint connections, lap joints, overhanging connections, resting overlapping tab connections, click to snap connections, bolt and nut, tongue and groove, and/or pressure coupled connections.

Figure 10:
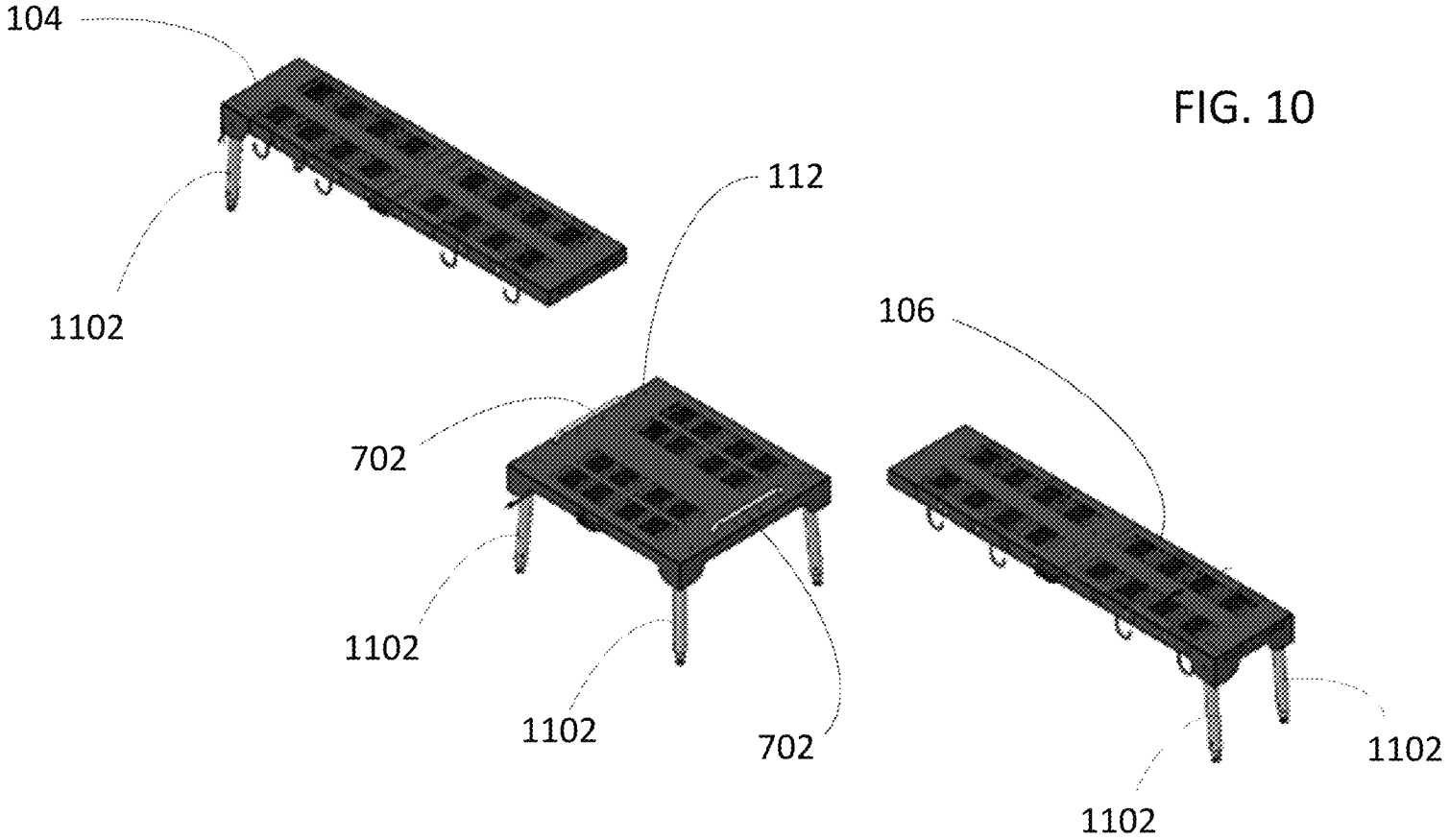
FIG. 10 presents a right-hand side top exploded perspective view of a workstation in accordance with an embodiment of the present invention.
Figure 12:
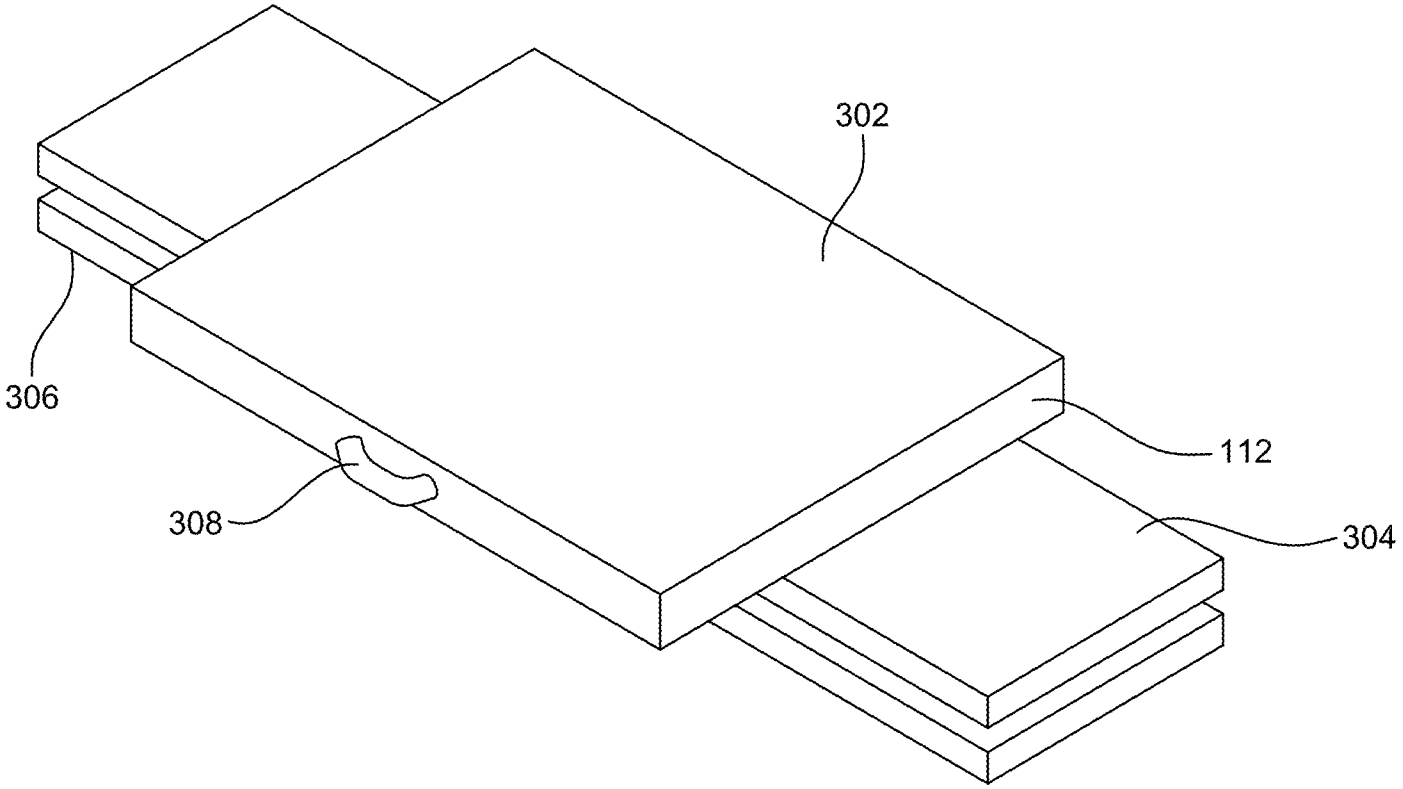
FIG. 12 presents a top right-hand side perspective view of a workstation in a folded orientation configured for transportation.

FIG. 10 presents an exploded view of an embodiment of the workstation 100. As shown, the workstation 100 can include folding collapsible legs 1102 so that the collapsible legs can be folded and drawn up into an underneath section of the center worktable 112 and extensions 104 and 106. When the collapsible legs 1102 are in the stored position underneath the worktable 112 and extensions 104 and 106 they can be connected together and transported by a person as an assembly as shown in FIG. 12. The workstation 100 can include clips on under surfaces of the worktable 112 and extensions 104 and 106 to allow efficient connection ability to quickly deploy the components for use and for quickly collapsing the pieces and connecting together to transport as a hand carried assembly.

Referencing FIG. 11, a front perspective view of an embodiment of the workstation 100 is shown. The workstation when assembled and deployed for use provides for a user of the workstation 100 to position hand tools and power tools on hooks 108 on an accessible front side of the workstation 100 to allow for ergonomic placement of tools along positions of the workstation 100 including worktable 112 and extensions 104 and 106 with surfaces 114 to provide efficiency and effectiveness for working on work product performing evolutions as shaping, cutting, sanding, carving, routing, burnishing, connecting, gluing, screwing, nailing, and/or other material shaping evolutions. The workstation 100 includes electrical outlets positioned underneath and behind the workstation to allow portable power tools and battery chargers to be placed and powered. Further, the workstation 100 can include dust and debris collection cavities 202 and 204 positionable underneath and on top of working surfaces and connected to vacuum systems to remove dust and debris created during material working procedures. In embodiments not shown the miter saw 102 can be replaced by a table saw, thickness planner, welding station, power planner, biscuit joiner, flat saw, and/or other material working devices.

Turning to FIG. 12, the components of the workstation 110 can be collapsible and interconnected so as to form a portable workstation assembly 1200. The portable workstation assembly 1200 can include extensions 104, 106, 114, 804, 806, and other workstation work surfaces and components enclosed in protective covers 304 and 306 and attached to protective cover 302 of the worktable 112. When interconnected, the assembly 1200 can be manually transported with a handle 308 positionable on a middle section of the protective cover 302 of the worktable 112. In embodiments not shown, the portable workstation assembly 1200 can also include wheels to allow a user to transport the portable workstation assembly 1200 over longer distances than carrying by hand.

In embodiments not shown the workstation 100 can include adjustable legs 110 arranged to support the workstation 100 components in such a way to allow a workstation 100 user to be in a wheelchair and to utilize the workstation 100. Embodiments which incorporate features to allow physically challenged personnel to operate and utilize the workstation 100 with appropriate clearances in accordance with the American with Disabilities Act of 1990 (ADA) are herein incorporated in the present application. Further, access elements of the workstation 100 can include compliance with ADA Standards for Accessible Design and with construction and design elements consistent with American Institute of Architects (AIA) with respect to clearances and accessibility to all workstation components. All code requirements and best practices are herein included in the workstation 100.

In embodiments not shown the workstation 100 can include interconnection points with a plurality of workstations 100 wherein the various other workstations 100 carry out specific evolutions on material and provide for a manufacturing/production style processing or production line.

In embodiments not shown the workstation can include plasticized or rubber lined edges and hooks in order to minimize physical injury caused by incidental contact by a user with the workstation.

While the foregoing written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above-described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail.

Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

What is claimed is:

1. A system suitable for use as a portable tradesperson workstation comprising:

A main table configured to support and connect with a material working apparatus, the main table positionable on top of and connected to associated adjustable support legs;

two center adjustment brackets positionable on top of and connected to opposite ends of the main table, wherein the two center adjustment brackets include an inverted U-shaped support element with an elongated horizontal portion and wherein the elongated horizontal portion forms an upper surface of the inverted U-shaped support element;

a preparation area extension, with associated adjustable support legs, connected to the main table with one of the center adjustment brackets on a top left-hand side of the main table;

a post product working area extension, with associated adjustable support legs, connected to the main table with the other center adjustment bracket on a top right-hand side of the main table;

and wherein the upper surface of the inverted U-shaped support element of the two center adjustment brackets interface with under surfaces of the preparation area extension and the post product working area extension with connection devices which are configured to connect and disconnect the preparation area extension and the post product working area extension from the main table by hand; and wherein the associated legs of the main table are foldable and collapsible within an underneath void of the main table to form a stored main table assembly, the associated adjustable support legs of the preparation area extension are foldable and collapsible within an underneath void of the preparation area extension to form a stored preparation area extension assembly, and the associated adjustable support legs of the post product working area extension are foldable and collapsible within an underneath void area of the post product working area to form a stored post product working area assembly and wherein the stored main table assembly, the stored preparation area extension assembly, and the stored post production working area assembly are connected together and configured for transportation as a portable tradesperson workstation.

2. The system of claim 1 wherein the two center adjustment brackets include independent height adjustment devices configured such as to allow the same or different elevation distances between the height of the preparation area extension, the main table, and the post product working area extension.

3. The system of claim 1 further comprising a vacuum system connected to a plurality of suction connections on the system.

4. The system of claim 1 further comprising transportation covers and wheels for transporting the system.

5. The system of claim 1 further comprising surface areas on the preparation area extension and the post product working area extension wherein a plurality of slots are symmetrically positioned on the surface areas designed to allow debris and dust to drop off the surface areas.

6. The system of claim 5 further comprising vacuum tray assemblies positioned underneath the slots arranged to collect the debris and dust.

7. The system of claim 6 further comprising a vacuum system attached to vacuum attachment connections designed to remove the debris and dust from the vacuum tray assemblies.

8. The system of claim 1 further comprising a plurality of micro roller mechanisms arranged symmetrically on surfaces of the system configured for enhanced precise product movement by users of the system.

9. The system of claim 1 further comprising a plurality of hooks arranged on a front side of the system and configured to allow ergonomically positioned hand and power tools to be placed for use by users of the system.

10. The system of claim 1 further comprising a plurality of electrical strips and power outlets ergonomically positioned on the system to allow system users access to efficient power supply and battery pack charging.

11. The system of claim 1 further comprising additional preparation area work extensions connectable end to end longitudinally and configured to provide a longer surface area for system users.

12. The system of claim 1 further comprising additional post product working area extensions connectable end to end longitudinally and configured to provide a longer surface area for system users.

13. The system of claim 1 further comprising a plurality of top surface layers positionable on top of working surfaces of the system to allow for smooth and lower friction surface interaction with material.

14. The system of claim 1 further comprising a plurality of handles positionable on workstation components and configured for hand carrying system components and covers.

15. The system of claim 1 further comprising a plurality of high precision bubble levels positionable on a front of the system and configured for carrying out detailed material working evolutions.

16. The system of claim 1 further comprising a plurality of precision vertical height adjustments with nut and bolt adjustment mechanisms on bottom of the adjustable legs.

17. The system of claim 1 wherein the preparation area extension and the post product working area extension include an electronic fence system.

18. The system of claim 1 wherein the preparation area extension and the post product working area extension include top and side device support slots configured to connect devices to the portable tradesperson workstation and to orient devices in 3-dimensions.

* * * * *